United States Patent [19]

Porter

[11] Patent Number: 4,460,044

[45] Date of Patent: Jul. 17, 1984

[54] ADVANCING HEATED ANNULUS STEAM DRIVE

[75] Inventor: Luther T. Porter, Anaheim, Calif.

[73] Assignee: Chevron Research Company, San Francisco, Calif.

[21] Appl. No.: 413,324

[22] Filed: Aug. 31, 1982

[51] Int. Cl.[3] ..... E21B 36/00; E21B 43/24

[52] U.S. Cl. ..... 166/252; 166/263; 166/272; 166/50; 166/191

[58] Field of Search ..... 166/263, 272, 50, 250, 166/252; 299/2

[56] References Cited

U.S. PATENT DOCUMENTS

| | | | |
|---|---|---|---|
| Re. 30,019 | 6/1979 | Lindguist | 166/50 |
| 3,474,862 | 10/1969 | Bruist | 166/272 |
| 3,994,340 | 11/1976 | Anderson et al. | 166/272 |
| 4,026,359 | 5/1977 | Closmann | 166/263 |
| 4,133,384 | 1/1979 | Allen et al. | 166/272 |
| 4,344,485 | 8/1982 | Butler | 166/272 |
| 4,368,781 | 1/1983 | Anderson | 166/272 |

*Primary Examiner*—Ernest R. Purser
*Assistant Examiner*—Mark J. Del Signore
*Attorney, Agent, or Firm*—G. W. Wasson; L. S. Gruber; Edward J. Keeling

[57] ABSTRACT

A method is disclosed for producing viscous petroleum from subsurface deposits. The method employs a vertical well and a horizontal well through the petroleum deposit. A combination of injection procedures through the horizontal and vertical well heat the viscous petroleum in the annulus around the horizontal well. Successive completion intervals are installed in the horizontal well to produce the heated petroleum. The petroleum is driven by a drive fluid passing through previously produced intervals.

14 Claims, 8 Drawing Figures

ADVANCING HEATED ANNULUS STEAM DRIVE

BACKGROUND OF THE INVENTION

This invention relates to a method and apparatus for the recovery of highly viscous petroleum from a tar sand, heavy oil sand, or other subsurface permeable formation containing viscous petroleum deposits. The method is performed using a well formed and completed substantially horizontally through the formation containing the highly viscous petroleum and an adjacent substantially vertical well in cooperating alignment with the horizontal well. The method is an improvement of a prior art method making use of a horizontal perforated casing positioned within the petroleum formation. An example of that method is found in U.S. Pat. No. 4,368,781, issued to Donald J. Anderson for Method of Recovering Viscous Petroleum Employing Heated Subsurface Perforated Casing Containing a Movable Diverting Means and assigned to the same assignee as the present application. The method of the present invention provides for more efficient fluid flow paths for injected drive fluids and produced fluids.

PRIOR ART

In the prior art method initial production is made possible by conduction heating from a horizontal well. When the heated formation has developed a zone of increased fluid mobility due to conduction heating, a steam drive of the movable petroleum is initiated. The steam drive causes the petroleum to move along the heated annulus at the exterior of the horizontal well. Injected steam and produced fluids are directed and channeled in such a manner that previously swept zones may be resaturated with movable petroleum, or, in the event of a steam drive breakthrough, the injected steam bypasses the heated petroleum leaving it in place in the formation.

BRIEF DESCRIPTION OF THE PRESENT INVENTION

The present invention involves the drilling and completion of a horizontal well in a heavy oil or tar sand reservoir. A vertical steam injection well is drilled in close proximity to the underground end of the horizontal well, preferbly within 15 to 20 feet. The horizontal portion of the horizontal well preferably extends about 1000 feet through the heavy oil or tar sand reservoir.

The vertical steam injection well is perforated adjacent to the underground end of the horizontal well. Likewise the horizontal well is perforated adjacent to the underground end of the steam injection well. Necessary sand control measures are taken and fluid flow communication is established between the two wells. Next, the horizontal well is completed through a first interval of the reservoir.

A completion interval at some distance, about 200 to 400 feet, from the vertical steam injection well is isolated with an internal permeable well completion section. The horizontal well is then dual completed as a producer and steam injector. Hot fluid is then circulated through the annulus of the horizontal well to heat the reservoir around the well. Eventually the formation around the horizontal well and adjacent to the injection well becomes heated enough to permit the hot fluid to flow out through the perforations in the horizontal well, into the formation, into the vertical injection well and up the injection well to the earth's surface. Continued injection causes the viscous fluids near the underground end of the horizontal well to become heated thus increasing their mobility due to reduced viscosity and eventually the viscous fluids are produced at the injection well and into the annulus of the horizontal well through the internal permeable well completion section.

The production at the wellhead of the injection well and the horizontal well is monitored and, at such time in the process when fluid production is well established in the horizontal well, the hot fluid injection through the horizontal well is discontinued and the injection of hot fluids through the injection well provides the hot fluids to both heat the formation and to move the viscous fluids into the horizontal well. When the hot fluid drive has progressed to the point of drive fluid breakthrough into the horizontal well production side, the horizontal well will be recompleted at another interval along the well. The well perforations in the previously completed interval of the horizontal well nearest to the injection well are then plugged off by means of a tubing plug at or near the packer. The horizontal well is then recompleted at some distance away from the old completion interval.

The production/injection equipment is then rerun into the horizontal well, and production is reinstated by conduction heating and hot fluid drive as previously done in the first production in the horizontal well.

This process of completing, producing, interrupting and recompleting proceeds along the horizontal well until substantially all recoverable viscous petroleum has been produced.

OBJECTS OF THE INVENTION

The object of the present invention is a method for producing viscous petroleum from subsurface deposits in an efficient and practical manner.

Another object in accord with the preceding object is a method for completing and operating well elements in a subsurface well to cause viscous petroleum to move into the well elements and to be transported to the surface above the well.

Further objects and features of the present invention will be readily apparent to those skilled in the art from the appended drawings and specification illustrating a preferred embodiment wherein.

DETAILED DESCRIPTION OF THE INVENTION

Figure 1:
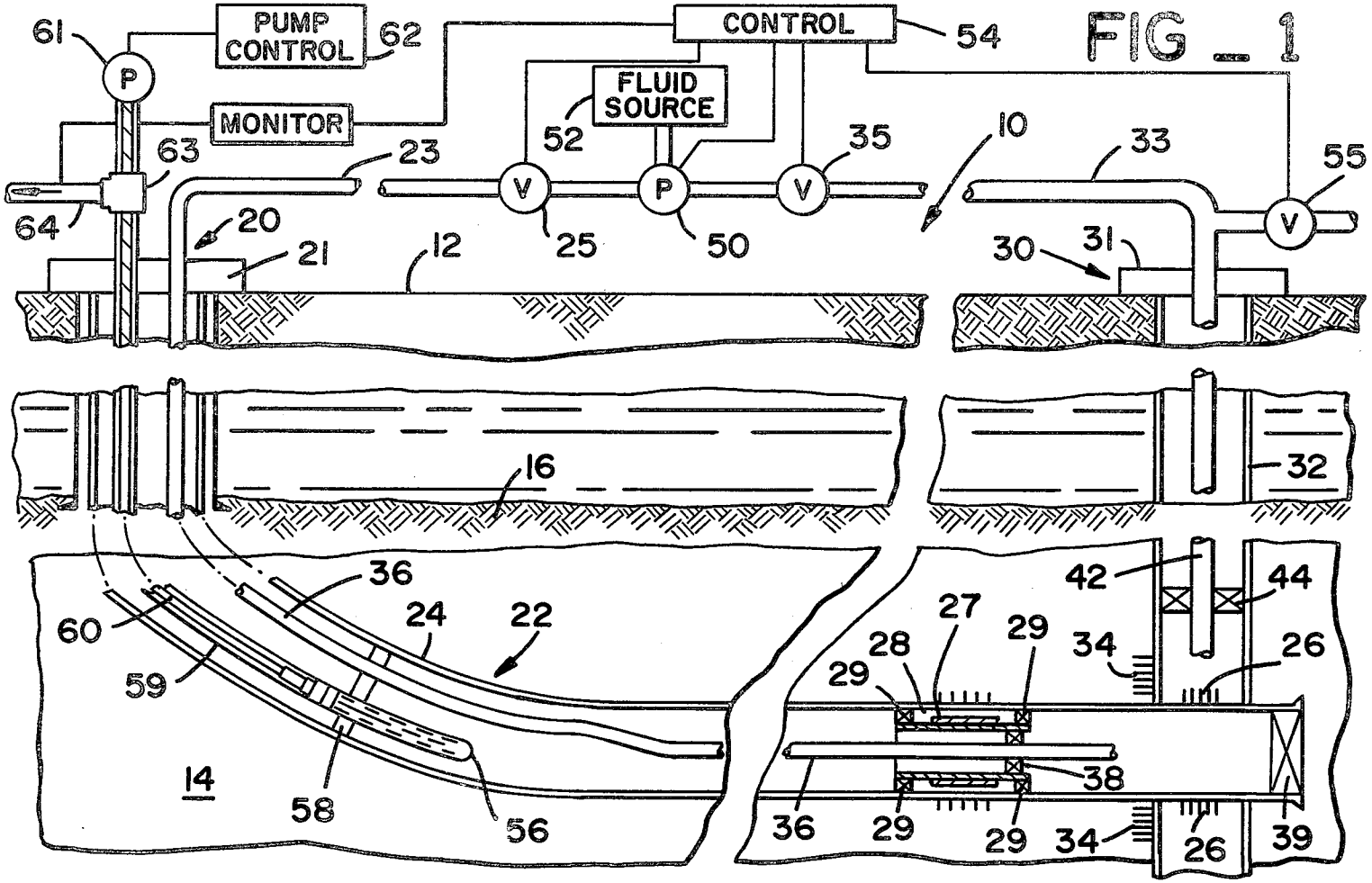
FIG. 1 is a sectional view through a subsurface earth formation illustrating surface and subsurface elements of the present invention.

FIG. 1 is a cross-sectional view through an earth formation illustrating a representative form of apparatus which may be used to perform the method of the present invention. As illustrated, the earth formation 10 generally includes a portion referred to as the earth surface 12 and the subsurface petroleum containing formation 14 with the additional earth formations separating the earth surface from the subsurface formation generally terminating in an impervious area 16 above the petroleum-containing formation. The formation containing the petroleum for which the present invention is particularly applicable is frequently characterized as a tar sand or a formation containing heavy viscous crude oils without sufficient natural drive to cause the petroleum to be producible through conventional geopressure drive or from conventional pumping techniques. Further, the formations for which the present invention is of particular interest, are those formations which are at a depth in an earth formation that would preclude the possibility of surface mining. The viscous petroleum of interest is that contained within the formation which is responsive to techniques that will cause its viscosity to be improved such that it becomes mobile and can be moved through the formation into suitable producing channels.

In the specific apparatus herein illustrated the first well 20 is drilled into the surface formations and through the impervious barrier 16 and then slanted into the formations to produce a wellhead 21 and a substantially horizontal well 22 having casing 24 passing horizontally through the formations. A second well 30 is drilled through the surface earth formations and into the petroleum-containing formation 14 and completed with a wellhead 31. Well 30 remains substantially vertical throughout its entire length and is completed into the subsurface formations with a casing 32.

The bottom hole end of the horizontal well 22 and the bottom hole end of the vertical well 30 are terminated in close proximity to each other, preferably within 15 to 20 feet of each other in the formations. Both wells are initially perforated at or near their downhole end to establish perforations 26 in the horizontal well and 34 in the vertical well. The horizontal portion of the horizontal well in the petroleum-containing formation preferably extends about 1000 feet through the formation 14.

The horizontal well, near to the vertical well 32 is completed with a casing liner 28 having packers 29 at each end and a producing interval at 27 which may be a wire-wrapped screen or a perforated gravel pack. The downhole end of the horizontal well is then completed with an injection tubing 36 passing through a packer 38 in the subsurface completion 28 to extend into the downhole end of the horizontal well to provide access to the well below the completion. The end of the horizontal well 22 is sealed with a packer or cement plug 39.

The vertical well 30 is completed with an injection tubing 42 passing through a packer 44 and into the downhole end of the vertical well for communication with perforations 34.

Tubing 36 in the horizontal well is completed through the wellhead 21 of well 20 and is connected through surface tubing 23 and valve 25 to a pump 50. In like manner, the tubing 42 of the vertical well 32 is completed through wellhead 31 and through surface tubing 33 to a valve 35 also in contact with the pump 50. A fluid source 52 is connected through the pump 50 and valves 25 and 35 to provide subsurface fluids to the horizontal well 22 and vertical well 32, respectively, all under the control of a suitable control device 54 which provides not only control for the fluid source 52 but also for valves 25 and 35 and an additional valve 55 which function will be described later on.

In FIG. 1 a second completion is illustrated in the horizontal well providing a producing element at 56 which may be a sucker rod pump or other type of pump positioned in dual tubing hanger 58 and connected to the wellhead 21 through tubing 59 which may contain the sucker rods 60 from a surface pump 61 under the control of pump control 62. The tubing 59 is adapted with a packing gland 63 to permit production to be passed through a suitable gathering piping 64.

Figure 2:
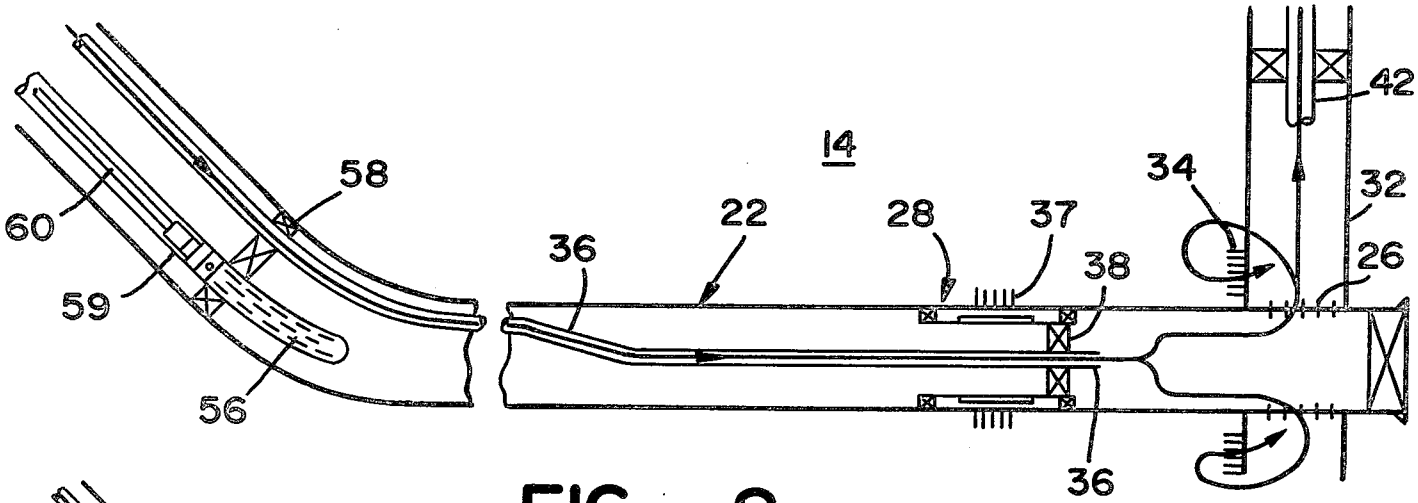
FIGS. 2–7 are sectional views through the subsurface portion of wells and the surrounding earth formation as illustrated in FIG. 1 and showing progressive operation of the method of the present invention through the subsurface elements.

FIGS. 2–8 illustrate a series of steps that may be performed with the apparatus of the present invention to accomplish the desired method of maximizing the production of the viscous crude from the earth formation in an efficient manner. In a tar sand or a heavy oil reservoir there may be little or no primary oil production. To produce the desirable oil, the formation adjacent to the production well, here shown as the horizontal well, is first heated by circulation of a hot fluid in the horizontal portion of the well to heat, by conduction, the formation surrounding the well. FIG. 2 illustrates the anticipated path of the hot fluids or steam down through the injection tubing 36 and into the downhole end of the horizontal well. The fluid is circulated through the tubing within the horizontal well 22, through the completion interval 28 which is isolated by the thermal packer 38, through the interval of the horizontal well between the completion interval 28 and the bottom end of the well, out the perforations 26 adjacent to the vertical injection well 32, and into the injection well through perforations 34 to then progress up and out of the steam injection well through the wellhead 31 and conductor 33 to be monitored at the control 54. The path of the hot fluid injection is shown by the darkened lines and the arrows running through the tubing 36 and upwardly through the vertical well 32. During this heating/injection operation, back pressure is held on the steam injection well such that the downhole pressure does not exceed the formation fracture pressure so as not to cause the formation to be separated or parted.

As soon as the viscous fluids near the horizontal well annulus become heated, their mobility will be increased, due to reduced viscosity, and these hydrocarbons will be produced into the injection well 32 along with the hot fluids. The production of such crudes can be monitored by the control 54 to determine when the viscous crude has become sufficiently mobile to establish reasonable production from the subsurface formation. At that time the production of hot fluids and hydrocarbons is discontinued in the injection well 32 and the flow of formation hydrocarbons is then reversed from flowing into the perforations 34 in the vertical well to flowing into the perforations 37 at the well completion interval 28 and through those perforations into the screen 27 and into the annulus inside of the horizontal well 22. As soon as productions of hydrocarbons begins into the horizontal well 22, injection of steam or hot fluids is started in the injection well 32. Sustained flow of formation hydrocarbons into the well completion interval 28 through perforations 37 is under the force of the continued injection of steam or hot fluids from the horizontal well 22 injection tubing 36 and the vertical well 32 injection tubing 42.

Figure 3:
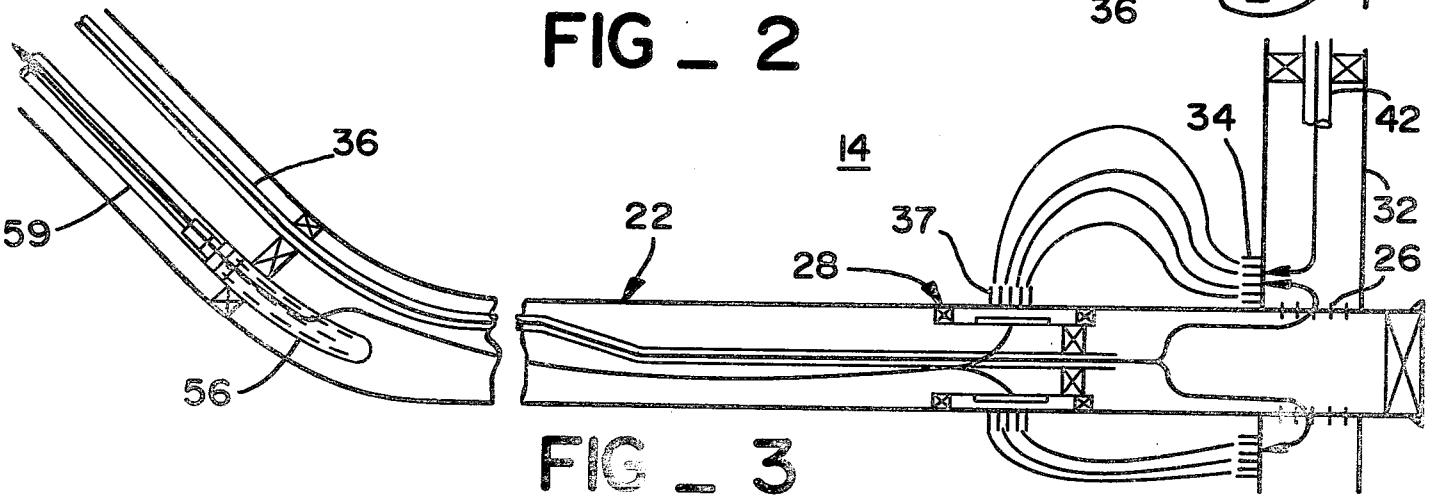

As illustrated in FIG. 3, the production of viscous petroleum from the formation 14 is driven by whatever steam injection is maintained from the horizontal well 22 and from the steam injection from the vertical well 32 to cause the petroleum to flow into the completed portion of the well at 28. Steam injection from the horizontal well may be terminated leaving only the drive from steam injected through the vertical well. The mobile petroleum flows through the sucker rod pump or othr pump 56 and upwardly to the earth surface through tubing 59.

Figure 4:
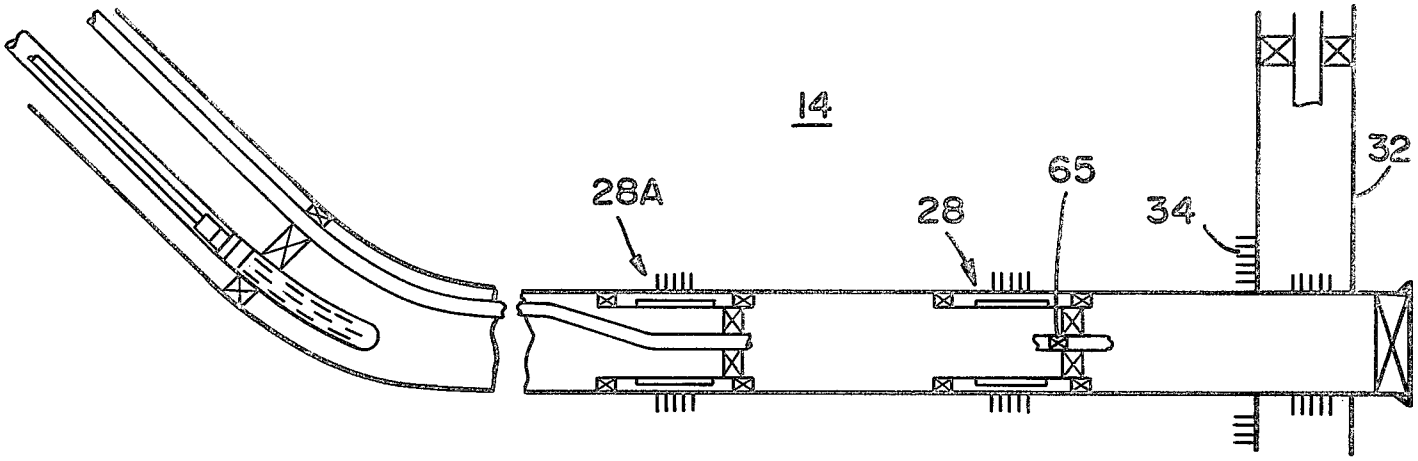

During this drive of the mobile petroleum, the steam is provided from the vertical injection well 32 and the pressure on that steam is such as to maintain a constant pushing force on the heated petroleum. When the steam drive has progressed to the point of a steam breakthrough into the horizontal well production side, the steam injection is temporarily terminated in the vertical well, the injection and production elements are withdrawn from the horizontal well, and a new completion interval is established in the horizontal well as illustrated in FIG. 4. Prior to establishing the new completion interval, a plug 65 is installed in the injection tubing 36 at the completion interval 28 so as to prevent any injection fluids from flowing through the previous completion and into the lower end of the horizontal well.

Figure 5:
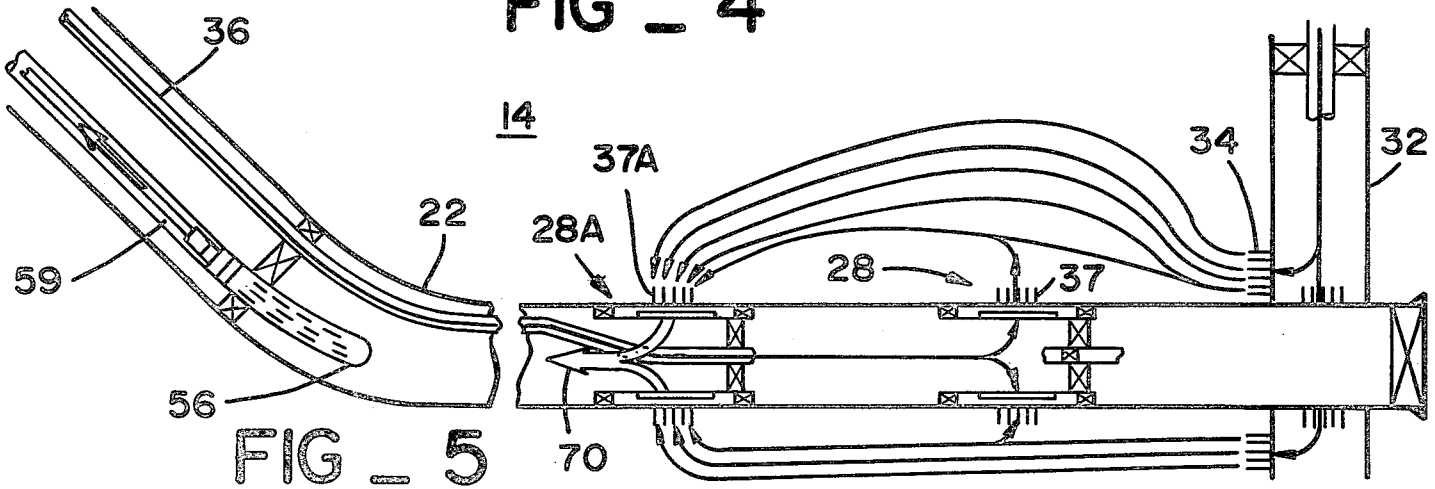

The new completion within the horizontal well is spaced along the horizontal well, a reasonable distance, for instance 300 to 600 feet, from the previous completion and a new completion interval 28A is established with duplicated packers, screens, and perforations as was established in the first completion interval 28, Prior to placement of the new completion interval, the production equipment is withdrawn from the well to permit the new equipment to be placed into the well and, when the completion is established, the production equipment is rerun into the horizontal portion of the well in the form as illustrated in FIG. 4. As illustrated in FIG. 5, the hot drive fluid is pumped through the injection well 32 and through the perforations 34 therein along with the fluids pumped through the injection tubing 36 to pass through the second completion interval 28A and in a reversed direction through the screen and perforations 37 of the first completion interval 28. The heavy viscous petroleum in the formation 14 is heated and pushed by the injection fluids and produced through the perforations 37A and completion interval 28A into the annulus of the horizontal well 22 as shown schematically by arrow 70. The production flows into the sucker rod pump or other type pump 56 and upwardly through the producing tubing 59.

Initial steam injection into the formation is possible due to the reservoir voidage and heating created by the production of viscous crudes during the completion as illustrated in FIGS. 2 and 3. The production response in this second completion will be expected to be more rapid than in the first completion since the residual heat energy will exist in the reservoir because of the initial steam injection through the horizontal well during the first production. Because of this residual heat and fluid mobility the distance between the second completion 28A and the first completion 28 can be increased over the distance that was required between the first completion interval 28 and the injection well 32.

Figure 6:
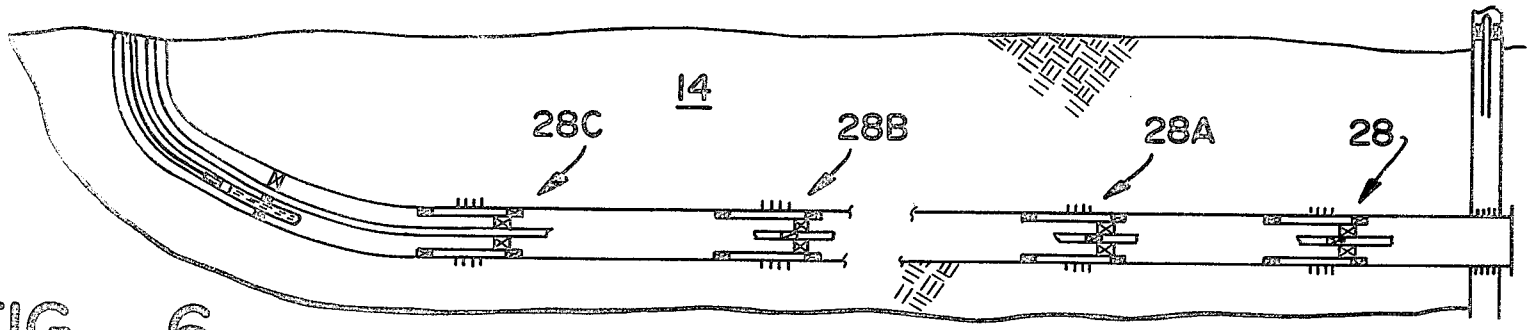
Figure 7:
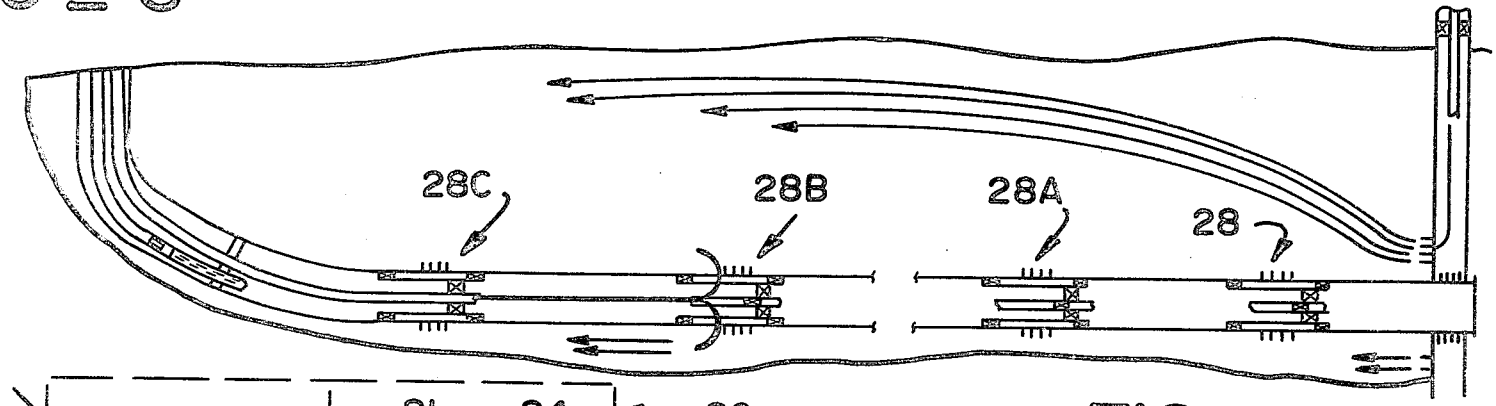

FIGS. 6 and 7 illustrate the final phases of a continuing production/steam drive after several recompletions and advancement of the steam drive front through the formation 14. As here illustrated, four separate recompletions (28, 28A, 28B and 28C) of the horizontal well have been established with each completion separated from the previous completion by a greater distance for the reasons described in the previous paragraph. While four completions are illustrated, it should be understood that this is merely representative of any plurality of completions. In each of these intervals the volume, temperature and the pressure of the hot fluid or steam injected via the horizontal well can be varied to avoid excessive heat losses to produced fluids. As should be expected, the horizontal well steam injection should be discontinued in each phase when significant steam condensate is produced. Production of steam condensate indicates that a path of high fluid mobility along the horizontal well annulus has been achieved and that fluid saturations have changed adequately for sustained production for the duration of the steam drive in that particular operation. The ratio condensate to produced formation fluid can be monitored at the production conductor 64 with a signal from this monitor provided to the control 54 to control over the fluids supplied through conductors 23 and 33 to the subsurface portions of the wells 22 and 32.

Previous proposals for the recovery of significant percentages of the petroleum in place in tar sands and other very high viscosity heavy oil reservoirs have required very close vertical well spacings. The typical proposals use a 2.5-acre, 5-spot or similar pattern, such as in a closely spaced 7-spot pattern. Prior proposals with regard to heated annulus horizontal wells have proposed a large number of vertical wells at very close spacing, for instance 100 to 300 feet between wells.

Figure 8:
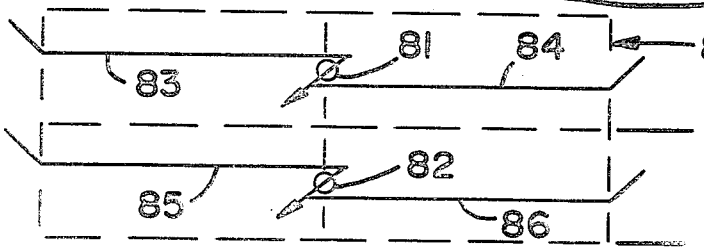
FIG. 8 is a schematic plan view of the method of the present invention operating several production wells with relationship to injection wells.

In the present proposal, the advancing heated annulus drive of producing viscous crudes, most of the vertical wells are eliminated thereby greatly improving the development economics. It is known that horizontal wells can be drilled extending in substantial long horizontal directions, for instance, wells have been drilled as much as 1000 feet in a horizontal direction from a vertical well. In that regard a single injection well may function to drive fluids into one or more horizontal wells which may be spaced in a variety of geometric patterns around the injection wells. FIG. 8 is a typical schematic illustration used by petroleum engineers to indicate the positioning of injection and production wells. As here illustrated in the production block 80 a pair of injection wells 81 and 82 are illustrated in the cooperating alignment with horizontal production wells 83, 84, 85 and 86. In the form illustrated each of the steam injection wells serves two horizontal wells. This pattern in spacing is superior to previous proposals in that fewer wells are needed to deplete a given subsurface formation volume. While not specifically illustrated, the present invention can be employed with other producing wells drilled into and adjacent to the horizontal well.

Throughout this specification the injection fluid has been referred to as fluid or steam. It should be understood that it is intended to include in such fluids, steam, solvents gases, and mixtures of such fluids that will be effective in heating, displacing and driving viscous petroleum through the subsurface formations.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

What is claimed is:

1. A method for assisting the recovery of viscous petroleum from a petroleum-containing formation comprising:

(a) forming and completing a substantially horizontal well through said petroleum-containing formation;

(b) forming and completing a second well having a portion thereof in close proximity to the subsurface end of said substantially horizontal well;

(c) perforating a portion of said substantially horizontal well near the subsurface end thereof adjacent to said second well;

(d) perforating a portion of said second well at said portion thereof in close proximity to said subsurface end of said substantially horizontal well;

(e) placing a packer and injection tubing in said substantially horizontal well near the subsurface end thereof, said tubing and packer being adapted to permit a first fluid to be injected through said substantially horizontal well and out said perforations therein;

(f) placing a packer and injection tubing in said second well, said packer and tubing being adapted to permit fluids to flow into or out of said tubing and said second well through said perforations therein;

(g) injecting said first fluid through said tubing in said substantially horizontal well, through said perforations therein, and into said second well through said petroleum-containing formation;

(h) monitoring the fluid produced from said second well to identify said first fluid and petroleum produced from said formation, said monitoring including identifying the ratio between said first fluid produced and said petroleum produced as well as the pressure of fluids in said second well;

(i) based on said monitored ratio and said producing pressure, injecting a second fluid through said tubing in said second well, through said perforations therein into said formation and through said formation into said substantially horizontal well;

(j) and producing said viscous petroleum and said fluids through said substantially horizontal well.

2. The method of claim 1 wherein said production of viscous petroleum into said substantially horizontal well is through a completion interval in and laterally along said substantially horizontal well away from said subsurface end thereof.

3. The method of claim 2 wherein said injection of said first fluid through said tubing in said substantially horizontal well and into said second well heats said petroleum-containing formation, and said injection of both said first fluid and said second fluid injected through said tubing in said second well moves said viscous petroleum in said heated petroleum-containing formation into said completion interval in said substantially horizontal well.

4. The method of claim 1 or 3 wherein produced fluids from said horizontal well are monitored for the ratio of said first and said second injected fluids to produced viscous petroleum fluid and, based on a predetermined ratio of said monitored fluids produced into said completion interval of said substantially horizontal well, changing said injection of said first fluid through said tubing in said substantially horizontal well while continuing injection of said second fluid through said tubing in said second well.

5. The method of claim 4 wherein said produced fluid through said completion interval is monitored for the ratio of produced viscous petroleum to said first and said second injected fluids and, based upon a predetermined monitored ratio, interrupting said injecting of said first injected fluid, plugging said tubing through said packer near the subsurface end of said substantially horizontal well and severing said plugged tubing from said remaining tubing, then placing a second packer in said substantially horizontal well along said remaining tubing and completing said substantially horizontal well at said second packer to isolate said substantially horizontal well below said plugged packer from said substantially horizontal well above said second packer, and reinitiating injection of said first injection fluid, said completion in said remaining tubing at said second packer being adapted to permit fluids to be injected through said substantially horizontal well and into said petroleum-containing formation through said previous completion interval, and producing said viscous petroleum and said injection fluids through said completion interval at said second packer in said substantially horizontal well.

6. The method of claim 5 with the production of viscous petroleum at successive completion intervals at spaced locations axially along said substantially horizontal well away from said subsurface end and spaced from successively plugged tubing severed from said injection tubing at packers in said substantially horizontal well.

7. The method of claim 6 wherein successive completion intervals are spaced increasing distances from each other at said spaced locations axially along said substantially horizontal well.

8. A method of assisting the recovery of viscous petroleum from a petroleum-containing formation comprising:

(a) forming and completing a substantially horizontal well through said petroleum-containing formation;

(b) forming and completing a second well having a portion thereof in close proximity to the subsurface end of said substantially horizontal well;

(c) injecting a hot first fluid through said substantially horizontal well and into said second well in a manner to cause said viscous petroleum adjacent to said horizontal well and said second well to become mobile;

(d) establishing a first completion interval in said substantially horizontal well near the subsurface end thereof;

(e) injecting a second fluid through said second well to cause said heated viscous petroleum to flow into said substantially horizontal well at said first completion interval;

(f) monitoring said produced viscous petroleum and said first and said second injected fluids and, based on a predetermined ratio, converting said first completion interval to an injection interval for injection of hot fluids into said petroleum-containing formation;

(g) establishing a second completion interval in said substantially horizontal well spaced from said converted first completion interval and said second well;

(h) and continuing injection of said second fluid through said second well and injection of said hot first fluid through said converted first completion interval to cause said heated viscous petrolum to flow into said substantially horizontal well at said second completion interval.

9. The method of claim 8 with the production of viscous petroleum ahd injected fluids at successive completion intervals at axially spaced locations along said substantially horizontal well away from said subsurface end, each successive completion connecting the previous completion to an injection interval.

10. The method of claim 1 or 8 wherein said injection fluid includes steam, solvents, gases, and mixtures thereof to heat, displace and drive said viscous petroleum through said subsurface formation.

11. The method of claim 4 wherein said change of injecting said first fluid is a change in the rate of injecting said first fluid.

12. The method of claim 4 wherein said change of injecting said first fluid is a change in temperature of injection of said first fluid.

13. The method of claim 4 wherein said change in injecting said first fluid is a termination of injecting said first fluid.

14. The method of claim 4 wherein said change in injecting said first fluid is a combination of changes in rate of injection and temperature of injection of said first fluid.

* * * * *

UNITED STATES PATENT AND TRADEMARK OFFICE

CERTIFICATE OF CORRECTION

PATENT NO. : 4,460,044

DATED : July 17, 1984

INVENTOR(S) : Luther T. Porter

It is certified that error appears in the above-identified patent and that said Letters Patent are hereby corrected as shown below:

Claim 9, Col. 8, line 2, "ahd" should read --and--.

Signed and Sealed this

*Fifteenth* Day of *January 1985*

[SEAL]

*Attest:*

GERALD J. MOSSINGHOFF

*Attesting Officer*

*Commissioner of Patents and Trademarks*